US010638847B2

(12) United States Patent
Mackert

(10) Patent No.: US 10,638,847 B2
(45) Date of Patent: May 5, 2020

(54) FOOTREST CHASSIS FOR ATTACHMENT TO A SEATING FURNITURE CHASSIS

(71) Applicant: Innotec Motion GmbH, Lippstadt (DE)

(72) Inventor: Michael Mackert, Rüthen (DE)

(73) Assignee: Innotec Motion GmbH, Lippstadt (DE)

( * ) Notice: Subject to any disclaimer, the term of this patent is extended or adjusted under 35 U.S.C. 154(b) by 0 days.

(21) Appl. No.: 16/082,233

(22) PCT Filed: Mar. 11, 2016

(86) PCT No.: PCT/EP2016/055330
§ 371 (c)(1),
(2) Date: Sep. 4, 2018

(87) PCT Pub. No.: WO2017/152998
PCT Pub. Date: Sep. 14, 2017

(65) Prior Publication Data

US 2019/0357685 A1 Nov. 28, 2019

(51) Int. Cl.
*A47C 7/50* (2006.01)

(52) U.S. Cl.
CPC ..... *A47C 7/5068* (2018.08); *A47C 7/5062* (2018.08)

(58) Field of Classification Search
CPC ..... A47C 7/5068; A47C 7/5062
USPC ..... 297/423.2, 423.22, 423.23, 423.24, 297/423.26, 423.28, 423.3
See application file for complete search history.

(56) References Cited

U.S. PATENT DOCUMENTS 5,328,247 A * 7/1994 Lovins ..... A47C 7/506 297/423.3
6,517,160 B2 * 2/2003 Marcantoni ..... A47C 7/506 297/423.28
6,692,078 B2 * 2/2004 Pham ..... A47C 1/0342 297/423.2 X (Continued)

FOREIGN PATENT DOCUMENTS

DE 202008000302 U1 4/2008
EP 2084992 A2 8/2009

(Continued)

OTHER PUBLICATIONS

International Search Report for corresponding PCT Application PCT/EP2016/055330, 4 pages, dated Oct. 14, 2016.

(Continued)

*Primary Examiner* — Rodney B White
(74) *Attorney, Agent, or Firm* — Edell, Shapiro & Finnan, LLC.

(57) ABSTRACT

A footrest chassis for attachment to a seating furniture chassis includes a first region, a second region, at least one attachment mechanism for securing the first region to the seating furniture chassis, and a connecting mechanism, wherein the first region and the second region can be pivoted about a first pivot axis defined by the attachment mechanism in the mounted state on the seating furniture chassis, and wherein the second region is connected to the first region by the connecting mechanism. During a pivoting movement of the first region and the second region about the first pivot axis, an additional pivoting movement of the second region takes place about a second pivot axis that is defined by the connecting mechanism.

11 Claims, 7 Drawing Sheets

(56) References Cited

U.S. PATENT DOCUMENTS 6,695,406 B2 * 2/2004 Plant ..... B60N 2/34 297/423.26
6,773,074 B2 * 8/2004 Flory ..... B60N 2/995 297/423.36 X
7,080,887 B2 * 7/2006 Tseng ..... A47C 1/035 297/423.28 X
7,273,257 B2 * 9/2007 De Vroe ..... A47C 1/035 297/452.26 X
7,824,349 B2 * 11/2010 Lv ..... A61H 7/007 297/423.22 X
8,444,225 B2 * 5/2013 Behe ..... B64D 11/06 297/423.26 X
8,444,226 B2 * 5/2013 Driessen ..... B60N 3/063 297/423.28
8,500,664 B2 * 8/2013 Numata ..... A47C 7/50 297/423.22 X
8,573,696 B2 * 11/2013 Kuno ..... A47C 7/506 297/284.11
8,870,289 B2 * 10/2014 Yin ..... A47C 7/506 297/423.22
9,192,239 B2 * 11/2015 Besler ..... A47C 1/035
9,821,692 B2 * 11/2017 Vyskocil ..... B60N 2/995
2001/0048239 A1 * 12/2001 Kogure ..... B60N 2/62 297/423.2
2005/0173963 A1 * 8/2005 Edrich ..... B60N 2/62 297/423.28
2009/0289477 A1 11/2009 Mackert et al.
2011/0043005 A1 2/2011 Fischer
2012/0181838 A1 * 7/2012 Wu ..... A47C 7/506 297/423.2

FOREIGN PATENT DOCUMENTS

JP 63-200710 A 8/1988
JP 2001000274 A 1/2001
WO 2011015316 A1 2/2011

OTHER PUBLICATIONS

Office Action issued in corresponding Japanese patent application No. 2018-566627, dated Feb. 25, 2020, with English translation.

* cited by examiner

FOOTREST CHASSIS FOR ATTACHMENT TO A SEATING FURNITURE CHASSIS

FIELD OF THE INVENTION

The present invention relates to a footrest chassis for attachment to a seating furniture chassis.

BACKGROUND

Footrest chassis are known from the prior art through manifest prior use. Footrest chassis are mounted on seating furniture chassis in order to increase the comfort for a user. In this specification, a chassis is understood to refer particularly a device to which a upholstery can be attached in order to produce a piece of seating furniture, such as a chair, and to enable the mechanical functions of the chair, such as retraction and extension.

The actual footrest on which the user can place his feet is attached to the footrest chassis. Usually, the footrest chassis can be extended and retracted, allowing the user to choose whether or not to place his feet on the footrest. When retracted, the footrest is located below the seating surface of the chair so that it does not disturb the user. In the extended state, the user can place his feet and, depending on the model, at least partially his legs on the footrest chassis.

Known footrest chassis require a lot of space below the seating surface of the seating furniture while being folded in or out. In addition, when the footrest is extended during the extending process in order to increase a distance between the seating surface and the end of the footrest facing away from the seating surface, the lower end of the footrest presses against the user's calves, which is generally uncomfortable for the user.

SUMMARY OF THE INVENTION

Unlike known footrest chassis, the present invention seeks to provide a footrest chassis that requires little space under the seat of the chair during the retracting and extending process and that increases the comfort of the user. Moreover, a system is to be provided with such a footrest chassis and a seating furniture chassis.

This object is achieved by means of a footrest chassis as disclosed herein and by a system as disclosed herein. Embodiments of the invention are disclosed herein.

The footrest chassis comprises a first region, a second region, at least one attachment means for securing the first region to the seating furniture chassis, and a connecting means. The first and the second regions can be pivoted in the mounted state on the seating furniture chassis about a first pivot axis that is defined by the attachment means. The second region is connected to the first region by means of the connecting means.

During a pivoting movement of the first region and the second region about the first pivot axis, an additional pivoting movement of the second region takes place about a second pivot axis that is defined by the connecting means. The second pivoting movement can be triggered automatically.

The pivoting movement of the second region about the second pivot axis makes it possible to retract and extend the footrest chassis in a space-saving manner. The second region is thus pivoted retracting and extending process both about the first pivot axis and about the second pivot axis, so that it performs a combination of these two pivoting movements. In other words, the first and the second pivoting movements of the second region overlap. The first region, however, is pivoted only about the first pivot axis and not about the second pivot axis.

Moreover, the pivoting movement of the second region about the second pivot axis can offer the advantage that the second region pivots out more quickly and can thus come into contact with the user's calf before the lower end of the footrest abuts the calves when the footrest chassis is extended during the extending process.

It is possible for a first part of a footrest to be attachable to the first region. A second part of the footrest can be attachable to the second region. This two-part design makes the previously described pivoting behavior of the first and the second regions possible.

It is also possible for the footrest chassis to be embodied in two parts. In this case, the footrest chassis may comprise two first regions, two second regions, two attachment means, and two connecting means, with it being possible for each of a first region, a second region, an attachment means, and a connecting means to be disposed on one of the two parts of the footrest chassis and for the mechanism of both parts of the footrest chassis to be the same or similar. This enables an especially lightweight footrest chassis to be achieved.

According to one embodiment of the invention, the connecting means can comprise a first connecting element and a second connecting element. The first connecting element can define the second pivot axis. The second connecting element can be designed to trigger the pivoting movement about the second pivot axis. The first connecting element can be a bolt, for example, around which a component of the second region can be rotated.

According to one embodiment of the invention, the second connecting element can be embodied in the manner of a lever. This lever-like second connecting element can, for example, be rotatably connected to the component of the second region, which can be rotated about the first connecting element. The pivoting movement of the second region about the second pivot axis can thus be triggerable by the second connecting element.

According to one embodiment of the invention, the attachment means can comprise a first attachment element and a second attachment element. The first attachment element can define the first pivot axis. The second attachment element can be designed to trigger the pivoting movement of the second region about the second pivot axis.

According to one embodiment of the invention, the second attachment element can be embodied in the manner of a lever.

According to one embodiment of the invention, the connecting means can comprise a third connecting element that connects the second connecting element to the second attachment element.

According to one embodiment of the invention, a pivoting movement of the third connecting element about a third pivot axis can be triggered by the second attachment element during the pivoting movement of the first region about the first pivot axis. The third connecting element can be supported, for example, by a bolt that defines the third pivot axis. As a result of a movement of the second attachment means relative to the third connecting means, the third connecting means is pivoted about the third pivot axis, whereby the second connecting element is moved. This results in the pivoting movement of the second region about the second pivot axis. The triggering relative movement of the second attachment means can be caused by the pivoting movement of the first region about the first pivot axis.

According to one embodiment of the invention, the second attachment element can be rotatably connected to the third connecting element.

According to one embodiment of the invention, the third connecting element can be rotatably connected to the second connecting element.

According to one embodiment of the invention, the footrest chassis can have a support surface that is designed to rest on a bearing means of the seating furniture chassis. The pivoting movement of the first region and the second region about the first pivot axis can be triggered by a deflection of the support surface. Such a coupling of the footrest chassis with the seating furniture chassis is advantageous in order to reduce the risk of damage or injury to objects, animals, or people who are in the folding path of the footrest chassis while it is being retracted. Since the footrest chassis rests with the support surface on the bearing means, a relatively small force acts on the object, the animal, or the person, thus reducing the risk of damage or injury.

The footrest chassis can still be attachable with the second attachment element to the seating unit chassis without increasing the risk of damage or injury. Since the pivoting movement of the first region about the first pivot axis is triggered by the deflection of the support surface, no such deflection takes place when an object, an animal, or a person is in the folding path of the footrest chassis. As a result, no movement of the second attachment element takes place relative to the third connecting means. Consequently, neither a pivoting movement about the first, nor a pivoting movement about the second, nor a pivoting movement about the third axis occurs.

According to one embodiment of the invention, the footrest chassis can comprise a spring means that is designed to exert a spring force on the support surface, so that the support surface is pressed against the bearing means. The support surface thus presses with a certain force against the bearing means that is sufficient for the process of retracting and extending the footrest chassis. If a person, an animal, or an object is in the folding path of the footrest chassis, only the spring force acts on the person, the animal, or the object. The spring force can be selected to be so low that the risk of damage or injury is low.

BRIEF DESCRIPTION OF THE DRAWINGS

Additional features and advantages of the present invention will become apparent from the following description of preferred embodiments with reference to the accompanying drawings. The same reference numerals are used for same or similar components and for components with same or similar functions. In the drawings.

DETAILED DESCRIPTION OF THE INVENTION

Figure 1:
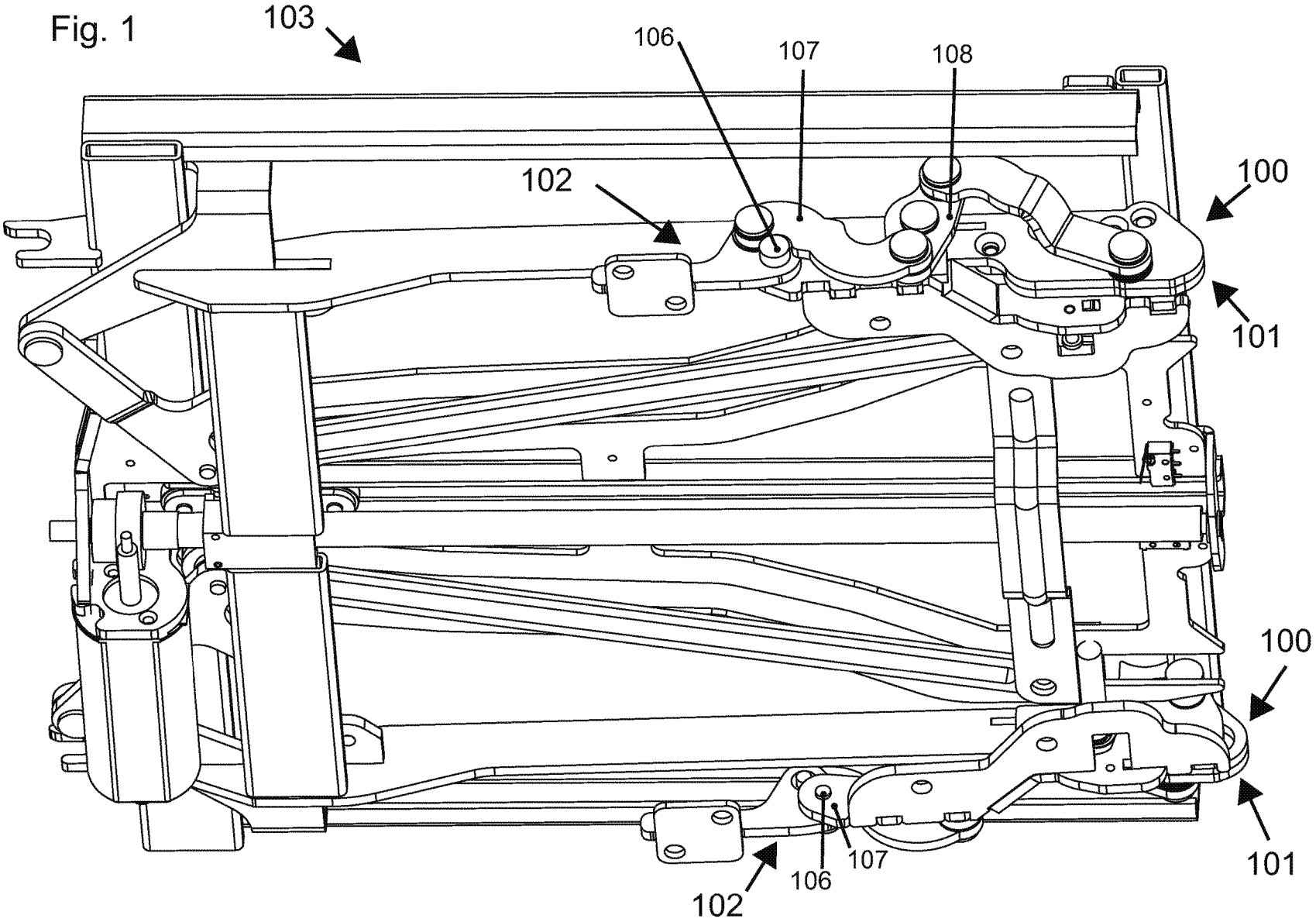
FIG. 1 is a schematic perspective view of a footrest chassis according to an embodiment of the invention that is attached to a seating furniture chassis in the retracted state.

A footrest chassis 100 extending operation can be understood by looking at the figures sequentially from 1 to 6. A retraction operation takes place exactly the opposite manner, so that it can be followed by viewing the figures sequentially from 6 to 1.

The footrest chassis 100 is attached to a seating furniture chassis 103 and comprises two parts that are interconnected only by the seating furniture chassis 103. The two parts are arranged parallel to each other and have the same structure, so that the retracting and extending process of both parts takes place in the same way. A footrest can be attached to both parts, thus interconnecting the two parts.

The footrest chassis 100 comprises a first region 101 and a second region 102. A first part of a two-part footrest can be attached to the first region 101. A second part of the footrest can be attached to the second region 102. The footrest chassis 100 is thus designed for a two-part footrest.

The first region 101 is fastened to the seating furniture chassis 103 by a first attachment element 104. The first attachment element 104 is embodied in the manner of a bolt and defines a first pivot axis about which both the first region 101 and the second region 102 are pivoted during the extending operation. Moreover, the first region 101 has a support surface 200 that is in contact with a bearing means 201 of the seating furniture chassis 103. A movement of the bearing means 201 triggers the pivoting movement of the first region 101 about the first pivot axis.

The support surface 200 is pressed by a spring means against the bearing means 201 such that only a spring force acts on an object, an animal, or a person when the object, animal, or person is in the folding path of the footrest chassis 100.

Moreover, the footrest chassis 100 has a second attachment element 105 that is attached to the seat furniture chassis 103. The second attachment element 105 is embodied in the manner of a lever.

The second region is connected to the first region 101 by a first connecting means 106 and a second connecting means 107. The first connecting means 106 is embodied in the manner of a bolt and defines a second pivot axis about which the second region 102 is pivoted. The second connecting means 107 is embodied in the manner of a lever. Moreover, the footrest chassis 100 comprises a third connecting means 108 that is rotatably connected to the second attachment means 105 and to the second connecting means 107, respectively. The second connecting means 106 is also rotatably connected to the second region 102.

When the footrest chassis 100 is extended, the bearing means 201 is pushed forward, so that the support surface 200 and the first region 101 are pivoted upward about the first pivot axis. This pivoting movement takes place counterclockwise and causes a relative movement between the second attachment element 105 and the third connecting element 108, resulting in a pivoting movement of the third connecting element 108. The pivoting direction of the third connecting element 108 is counter to the pivot direction of the first region.

The pivoting movement of the third connecting means 108 causes a relative movement between the second connecting means 107 and the first connecting means 106, so that the second region 102 is pivoted about the second that is defined by the first connecting means 106. This pivoting movement takes place in the same pivot direction as the pivoting movement of the first region 101 about the first pivot axis.

The second region 102 is thus moved by two superimposed pivoting movements about the first pivot axis and about the second pivot axis.

Figure 2:
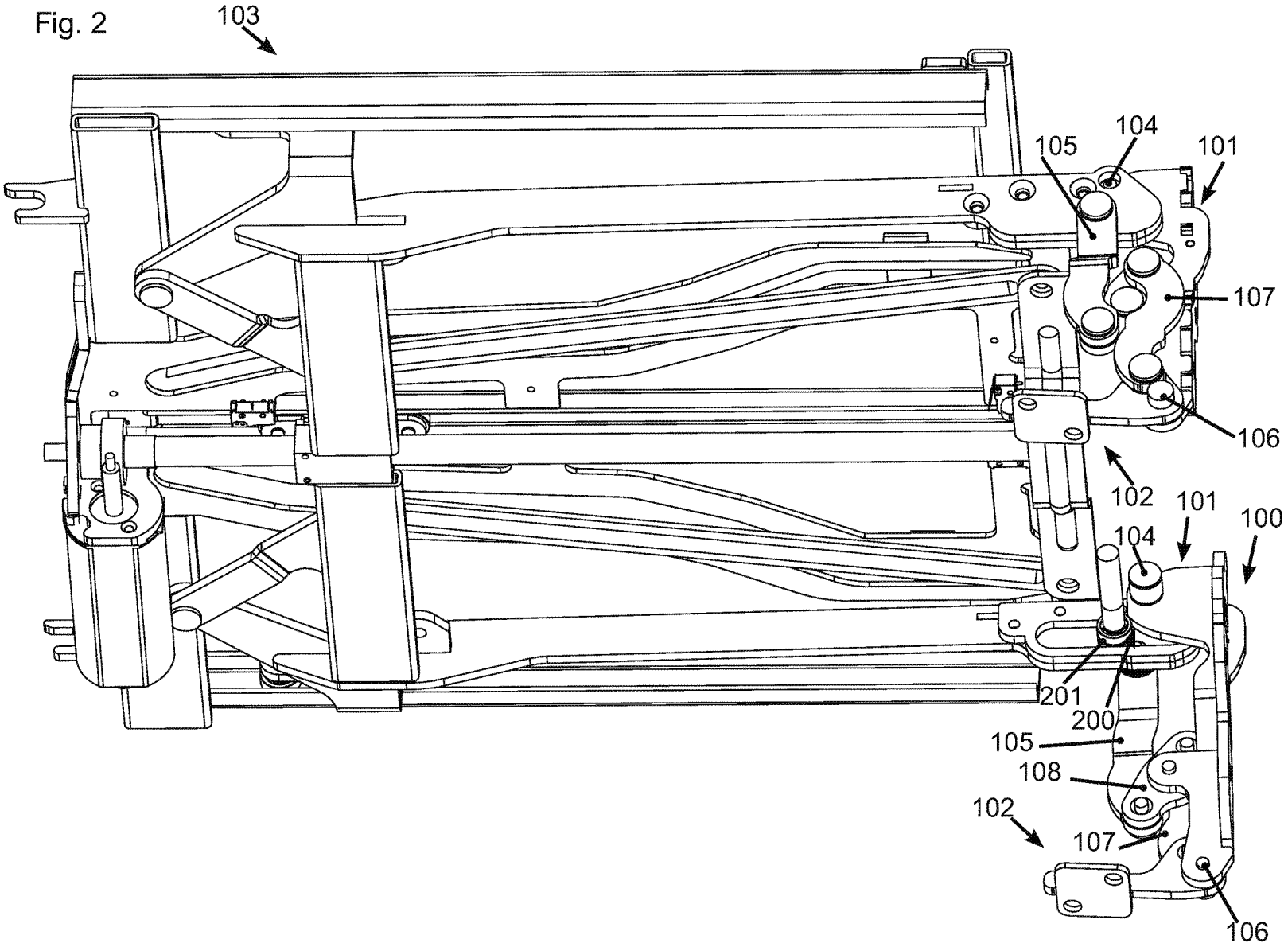
FIG. 2 is a schematic perspective view of the footrest chassis of FIG. 1 in a partially extended state.
Figure 3:
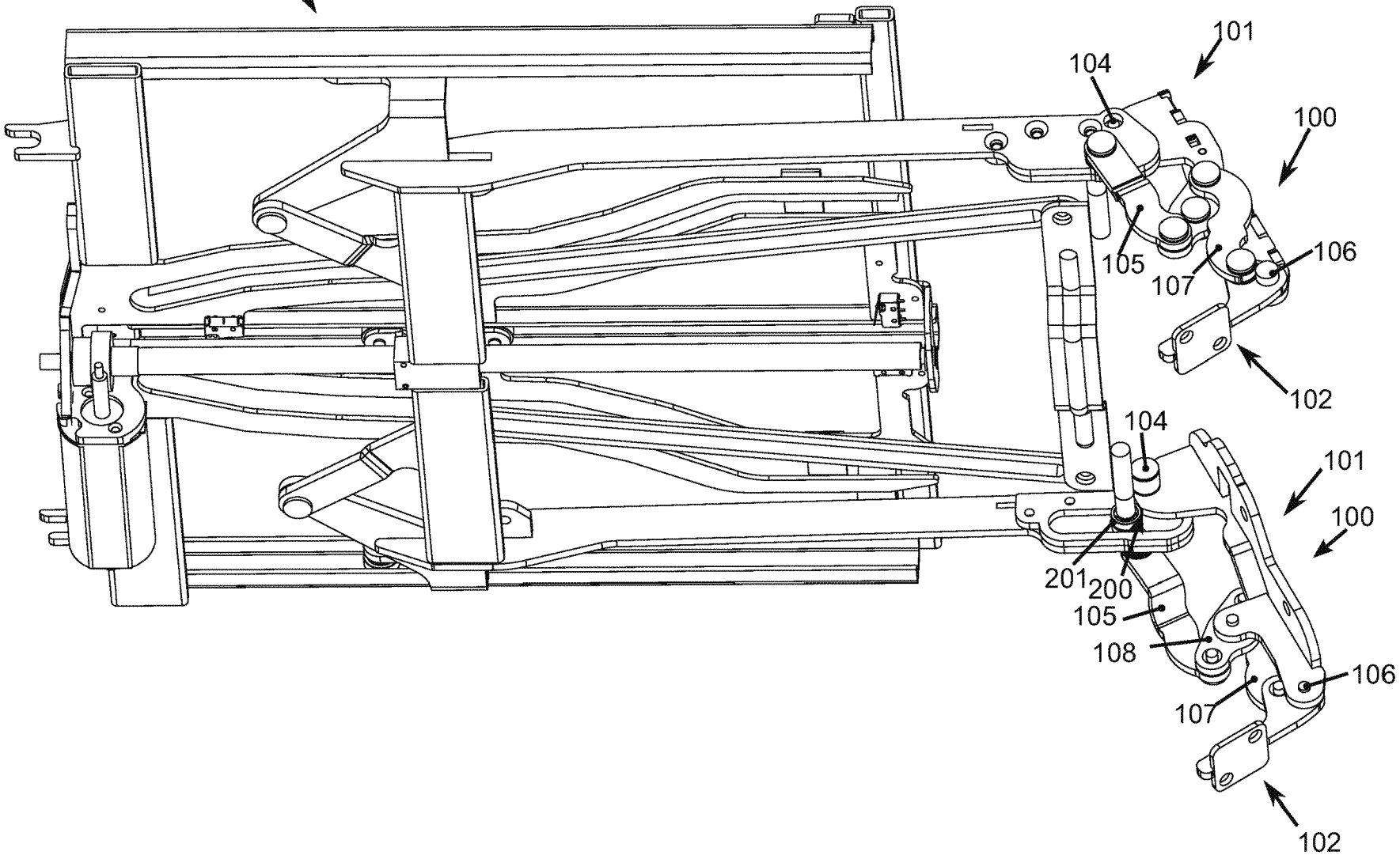
FIG. 3 is a schematic perspective view of the footrest chassis of FIG. 2 in a further extended state.
Figure 4:
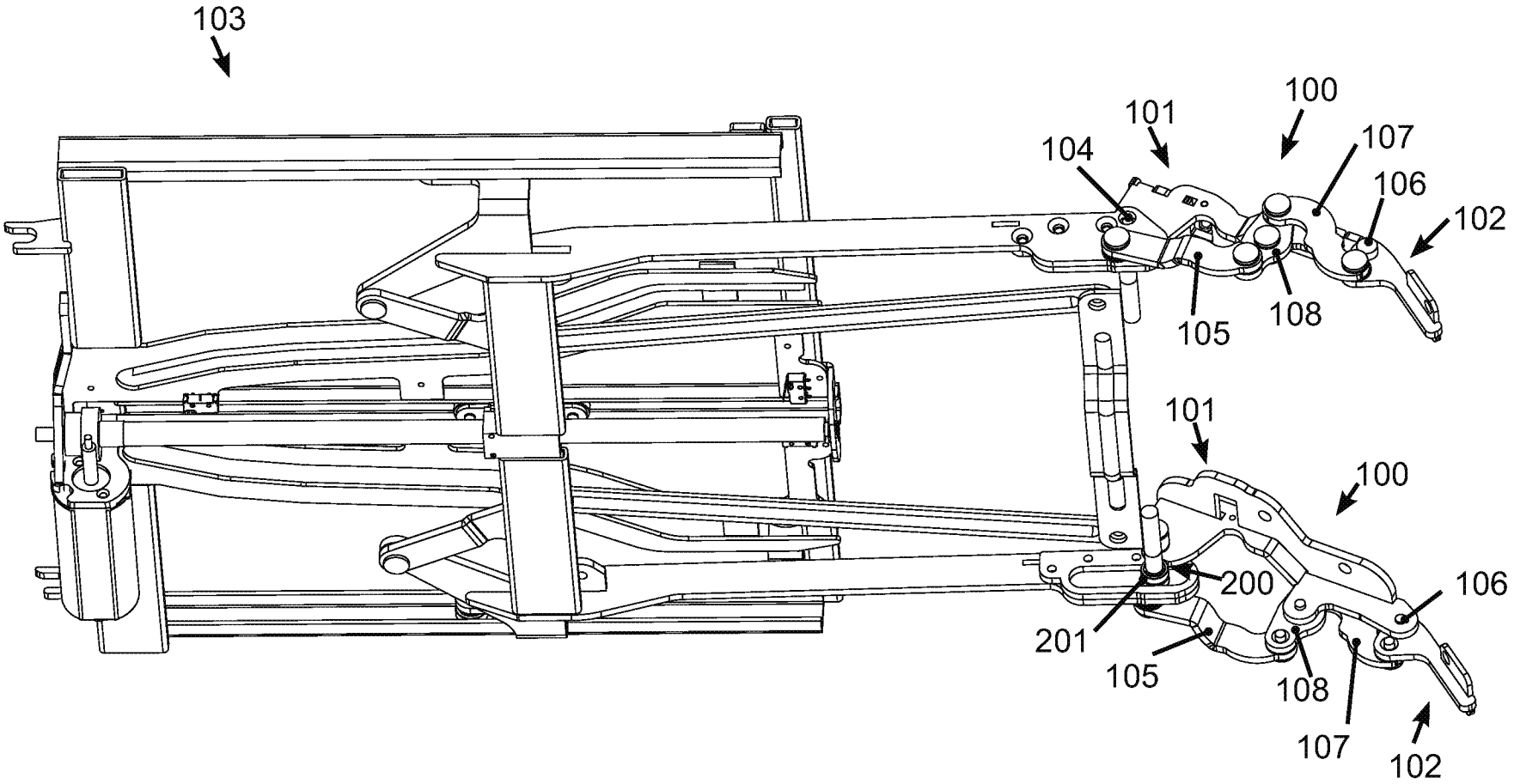
FIG. 4 is a schematic perspective view of the footrest chassis of FIG. 3 in a further extended state.
Figure 5:
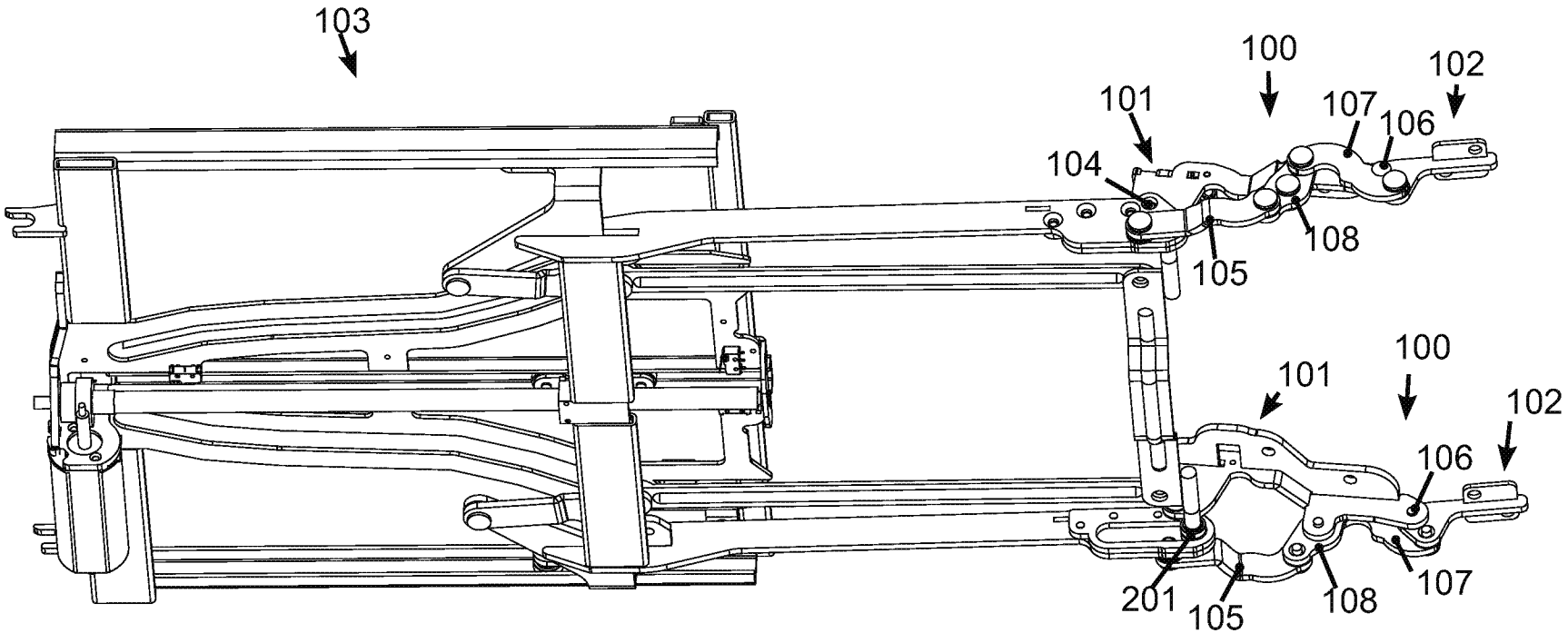
FIG. 5 is a schematic perspective view of the footrest chassis of FIG. 4 in a further extended state.
Figure 6:
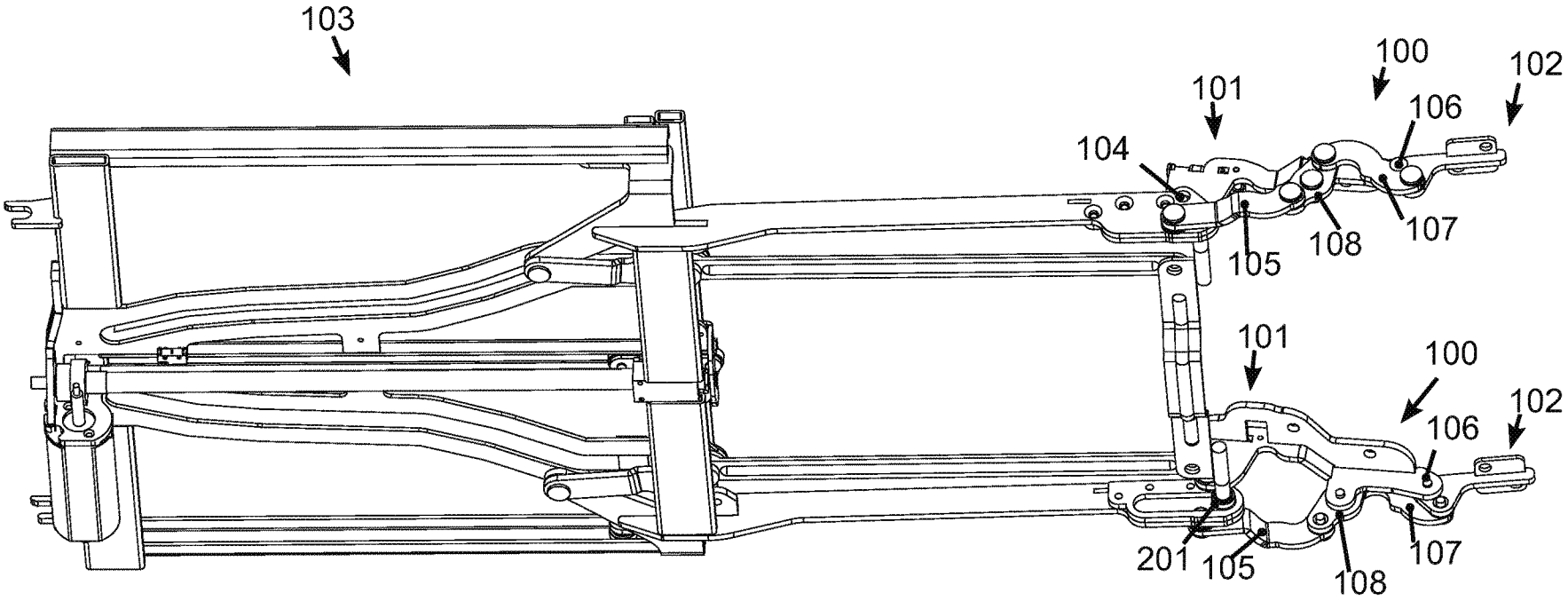
FIG. 6 is a schematic perspective view of the footrest chassis of FIG. 5 in a further extended state.
Figure 7:
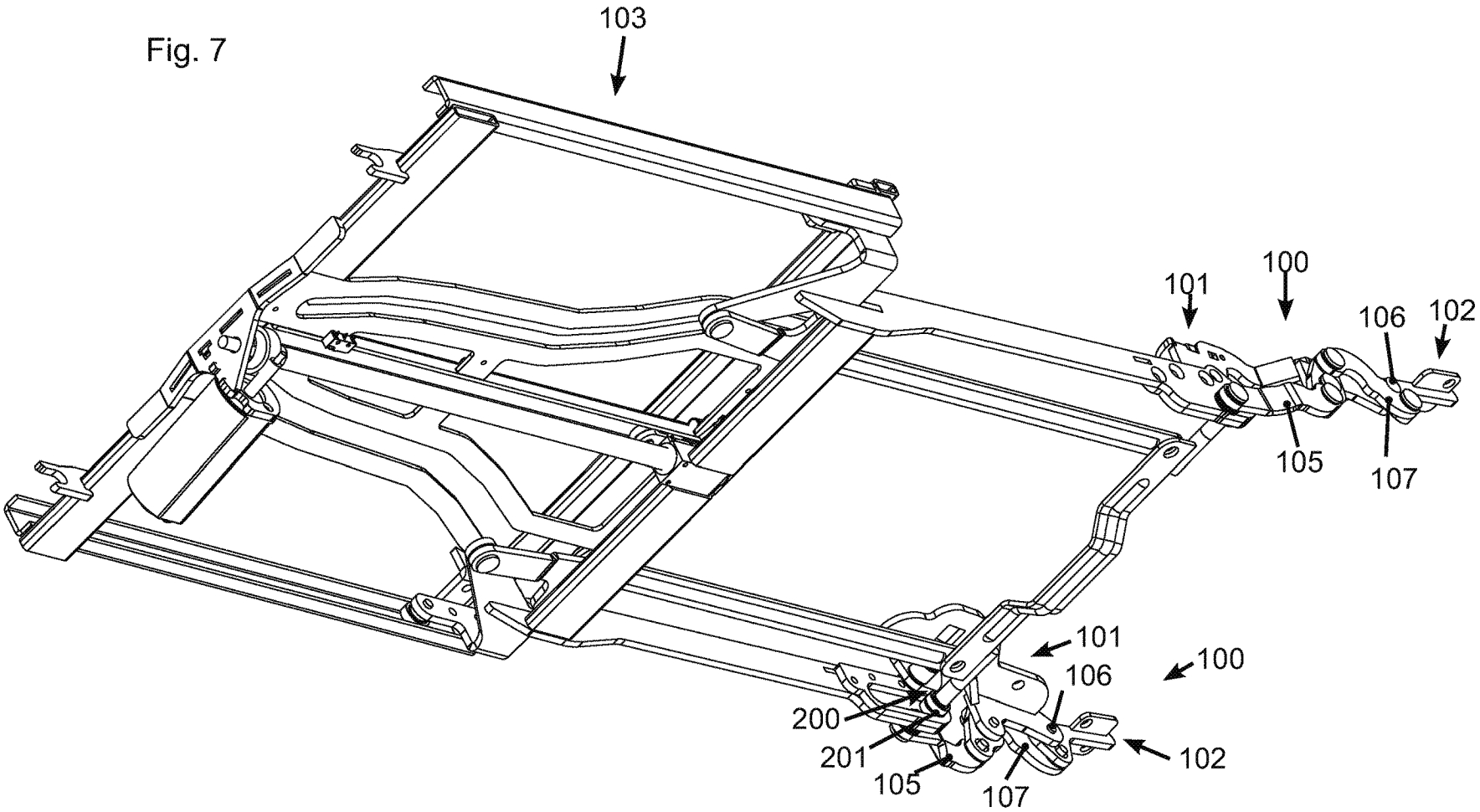
FIG. 7 is a schematic view of the footrest chassis of FIG. 6 from another perspective.

In particular, two advantages are achieved by the mechanism described above. For one, the footrest chassis 100 requires relatively little space below the seating surface of the seating furniture for the pivoting operation. For another, the footrest chassis 100 can be used particularly well in seating furniture chassis 103 in which the footrest chassis is retracted or extended during the stowage and deployment process. This advantage becomes especially clear in looking at FIGS. 2 to 4. The second region 102 is deployed such that the feet of a user come into contact with the footrest before the footrest touches the user's legs from behind. This is especially convenient for users, as it prevents unpleasant pointwise contact of the calves with the footrest.

What is claimed is:

1. A footrest chassis for attachment to a seating furniture chassis, comprising:

a first region, a second region, at least one attachment means for securing the first region to the seating furniture chassis, and a connecting means, wherein:

the first region and the second region are pivotable about a first pivot axis that is defined by the attachment means in the mounted state on the seating furniture chassis;

the second region is connected to the first region by the connecting means;

during a pivoting movement of the first region and the second region about the first pivot axis, an additional pivoting movement of the second region takes place about a second pivot axis that is defined by the connecting means;

the footrest chassis has a support surface designed to rest on a bearing means of the seating furniture chassis; and the pivoting movement of the first region and the second region about the first pivot axis can be triggered by a deflection of the support surface.

2. The footrest chassis according to claim 1, wherein the connecting means comprises a first connecting element and a second connecting element, wherein the first connecting element defines the second pivot axis and wherein the second connecting element is designed to trigger the pivoting movement about the second pivot axis.

3. The footrest chassis according to claim 2, wherein the second connecting element comprises a lever.

4. The footrest chassis according to claim 1, wherein the attachment means comprises a first attachment element and a second attachment element, wherein the first attachment element defines the first pivot axis and the second attachment element is designed to trigger the pivoting movement about the second pivot axis.

5. The footrest chassis according to claim 4, wherein the second attachment element comprises a lever.

6. A footrest chassis for attachment to a seating furniture chassis, comprising:

a first region, a second region, at least one attachment means for securing the first region to the seating furniture chassis, and a connecting means, wherein:

the first region and the second region are pivotable about a first pivot axis that is defined by the attachment means in the mounted state on the seating furniture chassis;

the second region is connected to the first region by the connecting means;

during a pivoting movement of the first region and the second region about the first pivot axis, an additional pivoting movement of the second region takes place about a second pivot axis that is defined by the connecting means; and the connecting means comprises a third connecting element that connects the second connecting element to the second attachment element.

7. The footrest chassis according to claim 6, wherein a pivoting movement of the third connecting element about a third pivot axis can be triggered by the second attachment element during the pivoting movement of the first region about the first pivot axis.

8. The footrest chassis according to claim 7, wherein the second attachment element is rotatably connected to the third connecting element.

9. The footrest chassis according to claim 7, wherein the third connecting element is rotatably connected to the second connecting element.

10. The footrest chassis according to claim 1, wherein the footrest chassis comprises a spring means that is designed to exert a spring force on the support surface, so that the support surface is pressed against the bearing means.

11. A system, according to claim 1 and a seating furniture chassis.

* * * * *